US006101663A

United States Patent [19]

Greer, Jr. et al.

[11] Patent Number: 6,101,663

[45] Date of Patent: Aug. 15, 2000

[54] CEILING SCRAPER WITH INTEGRAL DEBRIS COLLECTOR

[75] Inventors: Lester R. Greer, Jr.; Stephen E. Cunningham, both of Bellingham; James A. Tryon, Seattle, all of Wash.

[73] Assignee: Homax Products, Inc., Bellingham, Wash.

[21] Appl. No.: 09/168,309

[22] Filed: Oct. 7, 1998

Related U.S. Application Data

[60] Provisional application No. 60/062,507, Oct. 16, 1997.

[51] Int. Cl.[7] ..... A47L 13/02

[52] U.S. Cl. ..... 15/236.01; 15/248.1

[58] Field of Search ..... 15/236.01, 248.1, 15/248.2, 246; 30/169

[56] References Cited

U.S. PATENT DOCUMENTS

| | | | |
|---|---|---|---|
| 343,389 | 6/1886 | O'Neill et al. | 15/236.01 |
| 1,511,444 | 10/1924 | Charpentier | 15/236.01 |
| 2,693,785 | 11/1954 | West, Jr. | 15/248.1 |
| 2,820,290 | 1/1958 | Porter, Jr. | 15/248.1 |
| 3,025,549 | 3/1962 | Turner et al. | 15/248.1 |
| 4,031,589 | 6/1977 | Couch | 15/248.1 |

FOREIGN PATENT DOCUMENTS

| | | |
|---|---|---|
| 225893 | 3/1909 | Germany . |
| 699121 | 10/1953 | United Kingdom . |

*Primary Examiner*—Robert J. Warden, Sr.
*Assistant Examiner*—Andrew Aldag
*Attorney, Agent, or Firm*—Michael R. Schacht; Hughes & Schacht, P.S.

[57] ABSTRACT

An scraper system for removing acoustic texture materials comprising an integral debris collection assembly. The system comprises a scraper assembly comprising a scraper blade maintained at an angle with respect to a handle portion. A band is provided that defines at least a portion of a rectangular perimeter that, in use, is arranged below the scraper blade. A bag is attached to the band so that acoustic texture material removed by the scraper blade falls into the bag. The band is made of resilient material and is attached to the scraper assembly in a manner that allows the band to deflect when it contacts a wall surface adjacent to the ceiling surface. This allows the scraper blade to reach allow the way to wall surface. But the band returns to its original position with the perimeter defined thereby under the blade when the blade is not scraping near the wall surface.

8 Claims, 3 Drawing Sheets

CEILING SCRAPER WITH INTEGRAL DEBRIS COLLECTOR

RELATED APPLICATIONS

This application claims priority of U.S. Provisional Patent Application Ser. No. 60/062,507, which was filed on Oct. 16, 1997.

TECHNICAL FIELD

The present invention relates to systems and methods for removing material from interior surfaces and, more specifically, to such systems and methods that are adapted to remove acoustic texture material from ceiling surfaces.

BACKGROUND OF THE INVENTION

Texture material is often applied to flat surfaces such as walls and ceilings. The texture material creates a bumpy, irregular surface that is aesthetically pleasing and which helps to hide seams and the like formed by adjacent wall or ceiling panels. Texture material is a coating material that is sprayed on in liquid form and which dries to form the bumpy, irregular surface described above.

A class of texture materials contains particulates and creates an acoustic or "popcorn" texture pattern that is normally applied to ceilings. The present invention is of particular importance in the context of acoustic texture materials, and that application will be discussed herein.

Acoustic texture materials form a rather thick coating having discrete particles embedded therein. These particles are usually small polystyrene chips, but can be small flakes of other materials such as cork, perlite, vermiculite, and/or rubber. These particles are sound absorptive and deaden the sounds within a room having the surface coated with acoustic texture material.

The particles are loosely adhered to the coated surface by the binding agent in the texture material. Because the particles in acoustic texture material are only loosely adhered to the surface, surfaces coated with this material cannot be effectively painted or cleaned because the mechanical action of brushing or wiping the surface removes the acoustic particles. Over time the surface coated with acoustic texture material can become dirty and discolored; and if walls adjacent to the coated surface are painted, the color of the ceiling may no longer match that of the walls, if it ever matched.

Further, styles and tastes change over time; a homeowner with ceilings coated with acoustic texture material may desire a different look such as smooth, standard texture material, wallpaper, and/or other surface treatment.

Accordingly, at some point the coat of acoustic texture material needs to be removed, resulting in a stripped surface. Once the old coat is removed, a new coating of acoustic texture material, different type of texture material, wall paper, or smooth surface may be may be applied the stripped surface.

The process of removing acoustic texture material basically comprises the steps of applying water or other solvents to the coating to be removed, scraping the moistened coating from the ceiling surface, and removing the waste material. This process is laborious, messy, and time consuming.

Specialized tools have been proposed for the removal of acoustic texture material from ceiling surfaces. These include a scraper coupled with a basket to collect waste material as it is being removed. Such tools have not gained significant acceptance in the marketplace.

OBJECTS OF THE INVENTION

From the foregoing, it should be apparent that one primary object of the present invention is to provide improved tools and methods for removing material from ceiling surfaces.

Another more specific purpose of the present invention is to provide ceiling scrapers and scraping methods having a favorable mix of the following characteristics:

- allows texture material and other waste material to be efficiently removed from ceiling surfaces by hand;
- allows removal of debris material and collection of removed debris material at the same time;
- allows removal and collection of debris material in corner areas defined by ceiling surfaces and intersecting wall surfaces; and
- can be manufactured inexpensively and reliably.

SUMMARY OF THE INVENTION

These and other objects are obtained by the present invention, which is a ceiling scraper with integral debris collector comprising a scraper blade and a collection assembly. The scraper blade is mounted on a base or handle that allows the blade to be brought into contact with the ceiling surface. Displacing the blade along the ceiling surface scrapes away debris materials such as acoustic texture material and the like. The collecting assembly comprises a collection bag and a collection member that supports the collection bag below the scraper blade. Thus, as the debris material is removed from the ceiling, it falls directly into the collection bag. When the collection bag is full, it is removed and emptied or replaced with an empty bag.

The collection member is deformable. Accordingly, when the ceiling scraper is used to scrape the ceiling near the corner area, the collection member will engage the wall near the corner and deflect to allow the scraper blade to reach all the way to the corner.

In the preferred embodiment, the blade is rigidly connected to a base that attaches the blade to a handle to facilitate manipulation of the blade. The blade and handle are set at an angle to each other such that the blade engages the ceiling surface at the correct angle for removing debris material.

The collection member is also rigidly connected to the base to define a closed loop below a scraper edge of the scraper blade. A collection bag is inserted through the closed loop with its edges around the outside of the collection member such that material removed by the scraper blade falls directly into this collection bag.

The collection member is preferably a metal band that is bent at four locations to define five sections. When the collection band is attached to this base member, the closed loop formed by the collection member of the preferred embodiment is generally rectangular, with the four bent locations defining five portions or sections of the band material. The endmost two of these sections are attached to the base at locations spaced from the side sections to allow the endmost sections to deform and thereby allow the scraper blade to move relative to the collection member. Thus, as the scraper blade moves towards the corner, once the collection member engages the wall adjacent to the corner it stops moving and the scraper blade continues to move until it engages the wall. The collection bag still remains underneath the scraper edge of the scraper blade so that the debris material removed thereby falls into the scraper bag. The collection assembly thus does not interfere with scraping of the ceiling surface and substantially the entire ceiling surface may be removed using the ceiling scraper of the present invention.

Other objects, advantages, and features of the present invention will become apparent from the following detailed description of the preferred embodiment.

DETAILED DESCRIPTION

Figure 1:
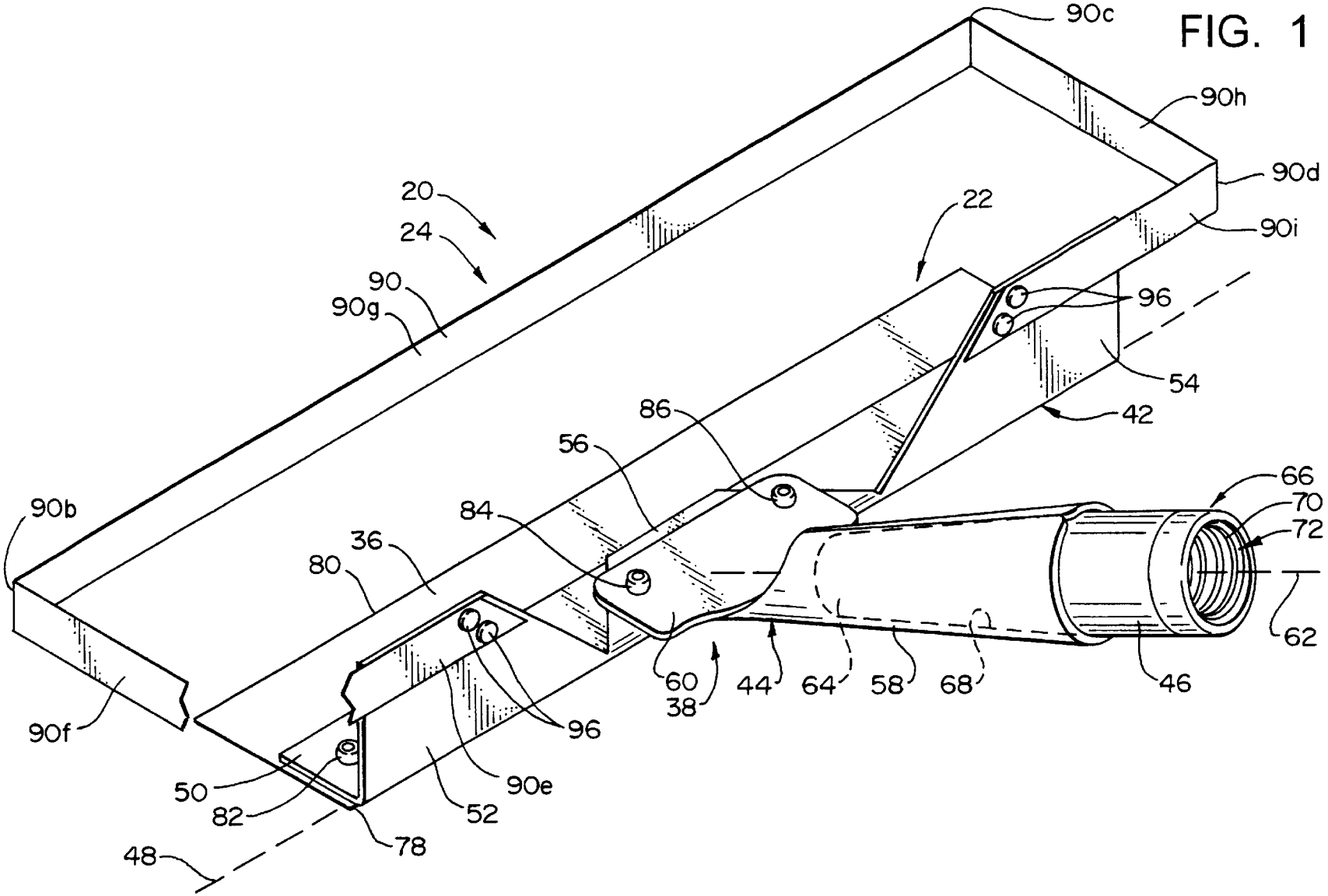
FIG. 1 is a partial, perspective view depicting a scraper system of the present invention.

Referring initially to FIG. 1, depicted therein is a scraper system 20 constructed in accordance with, and embodying, the principles of the present invention. The scraper system 20 comprises a scraper assembly 22 and a debris collection assembly 24; certain components of the scraper assembly 20 are not shown for purposes of clarity in FIG. 1.

Figure 2:
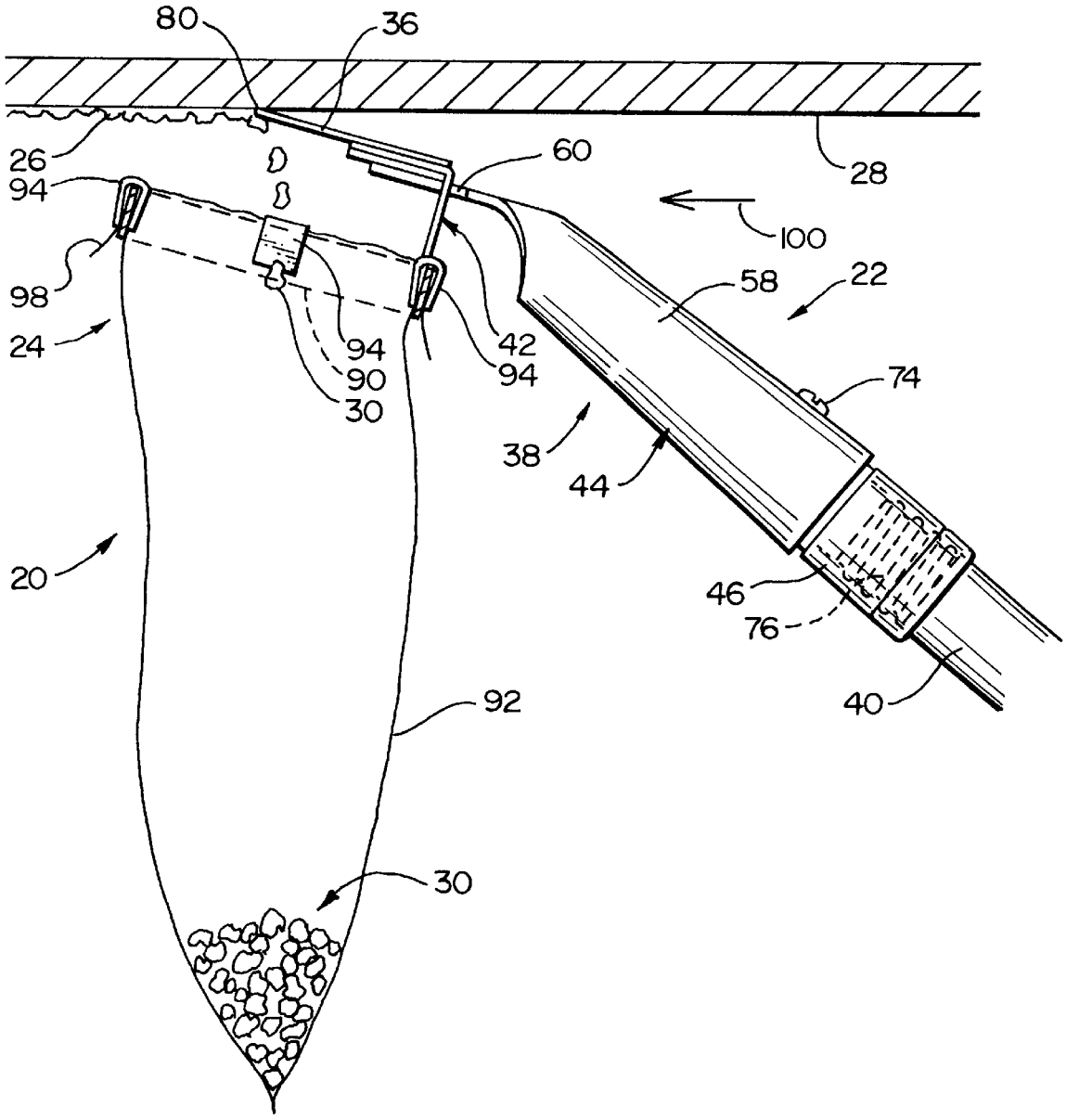
FIG. 2 is a side elevational view depicting the method of using the scraper system depicted in FIG. 1.

As generally shown in FIG. 2, the scraper system 20 is designed to facilitate removal of a coating 26 of texture material from a ceiling surface 28. The scraper assembly 22 scrapes the coating 26 off of the surface 28; the debris collection assembly 24 collects waste texture material 30 after it has been scraped off of the surface 28.

Figure 3:
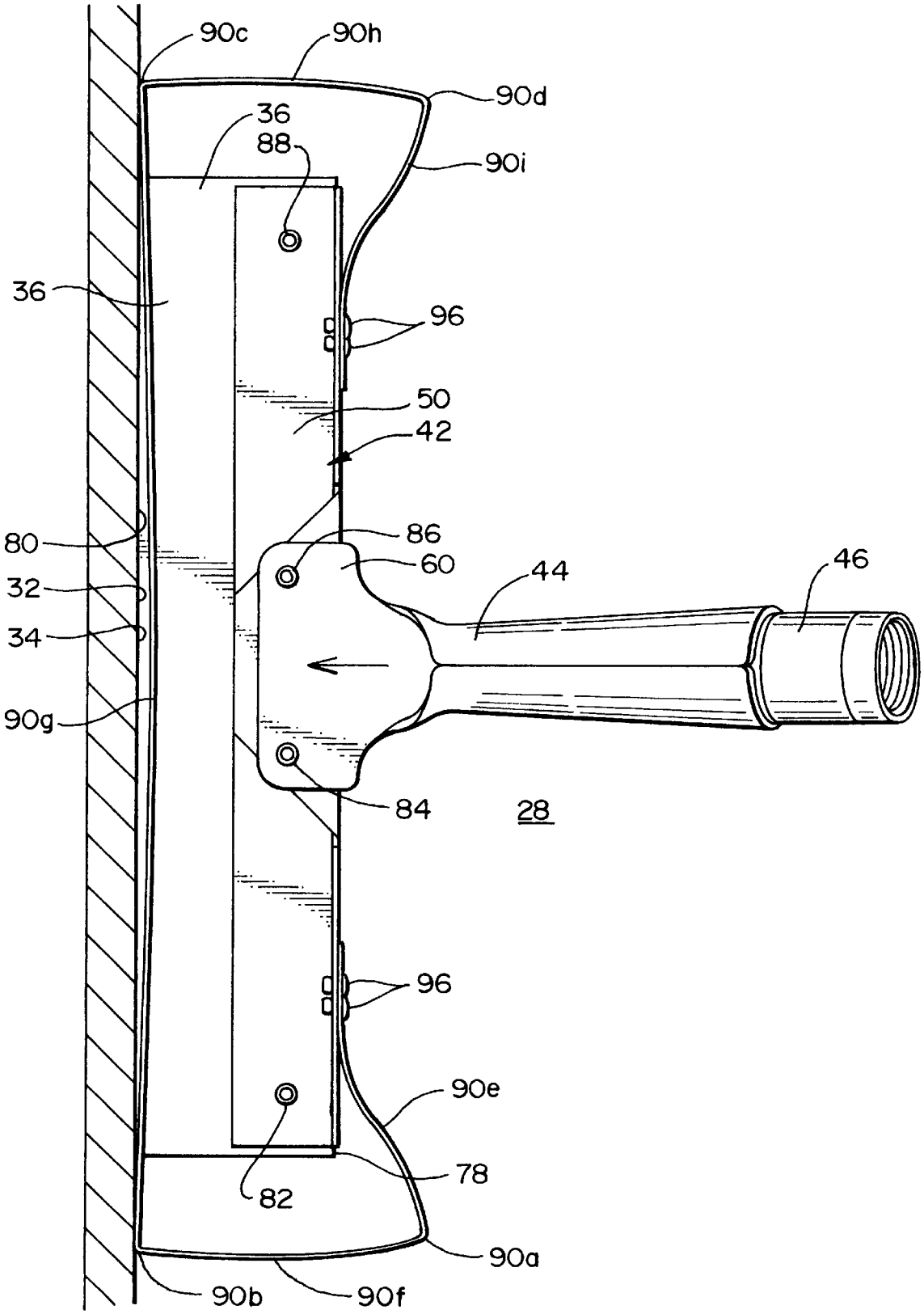
FIG. 3 is a bottom plan view of the system of FIG. 1 being used to remove material at a juncture of a ceiling surface and a wall surface.

As shown in FIG. 3, the scraper system 20 allows the texture material coating 26 to be removed from the surface 28 at a corner 32 formed by the ceiling surface 28 and an adjacent wall surface 34. The debris collection assembly 24 deflects to allow the scraper assembly 22 to remove the coating 26 all the way to the corner 32.

With this understanding of the basic operation of the system 20 in mind, the details of construction and use of the system 20 will now be discussed.

The scraper assembly 22 comprises a scraper blade 36 and a connecting assembly 38. The connecting assembly 38 can form a handle that may be gripped to operate the system 20. Optionally, the connecting assembly 38 can be used to rigidly connect the scraper blade 36 to an extension handle 40 (FIG. 2) that allows the user to reach the ceiling surface 28.

The scraper blade 36 is made of hardened and tempered spring steel commercially available from Lapham-Hickey Steel Corp. under the following ordering information: C1095 round edge 30 N66.5/68.5 blue polished. This material is purchased in rolls and is cut into the desired length.

The connecting assembly 38 comprises a base member 42, an angle member 44, and a transition member 46.

The base member 42 starts out as a sheet of flat metal die cut to have two generally triangular notches removed therefrom. The notched flat sheet is then bent along a line 48 to form a blade mounting portion 50, first and second side flanges 52 and 54, and a handle mounting portion 56. The triangular notches in the flat sheet separate the handle mounting portion 56 from the first and second side flanges 52 and 54.

More specifically, after the notched flat sheet is bent along the line 48, the side flanges 52 and 54 extend at substantially a right angle to the blade mounting portion 50 and the handle mounting portion 56 is folded back over such that it is substantially parallel to the blade mounting portion 50.

The angle member 44 and transition member 46 are commercially available as a unit from Michigan Brush under the part number 8910. The exemplary angle member 44 is made of metal, while the exemplary transition member 46 is made of wood.

The angle member 44 is formed from a flat sheet of die cut metal shaped such that it comprises a frustoconical portion 58 and an attachment portion 60. The frustoconical portion 58 defines a longitudinal axis 62 that intersects a scraper plane defined by the attachment portion 60 at a scraper angle.

The exemplary transition member 46 is shaped such that it has a frustoconical end 64 and a threaded end 66. The frustoconical end may optionally be splined or cylindrical with a retaining pin. The frustoconical end 64 is snugly received within a cavity 68 formed by the frustoconical portion 58 of the angle member 44. The threaded end 66 comprises an internal surface 70 that is threaded to define a threaded chamber 72. As shown in FIG. 2, a fastener 74 is inserted through the frustoconical portion 58 of the angle member 44 and into the frustoconical end 64 of the transition member 46 to prevent the transition member 46 from being separated from the angle member 44. Optionally, the angle member 44 and transition member 46 may be glued, welded, keyed, or otherwise rigidly connected together.

The threaded chamber 72 is configured to receive an externally threaded end 76 (FIG. 2) of the extension handle 40. The extension handle 40 is conventionally available in the market place as a broom or mop handle or a paint roller extension handle, and the threaded end thereof has a conventional thread pitch, with the thread pitch of the threaded chamber 72 matching that of the broom handle end 76.

The scraper assembly 22 is assembled as follows. The scraper blade 36, base member 42, angle member 44, and transition member 46 are initially provided as described above. The base member 42 is then arranged between the blade member 36 and the attachment portion 60 of the angle member 44 in an assembly configuration that is perhaps best shown in FIG. 3.

In particular, as shown in FIG. 3 the blade mounting portion 50 of the exemplary base member 42 is parallel with the blade member 36, with the bend line 48 of the base member 42 being immediately adjacent to a back edge 78 of the scraper blade 36. In the assembly configuration, a front edge 80 of the scraper blade is spaced a predetermined distance from the base member 42. FIG. 3 also shows that, in the assembly configuration, the attachment portion 60 of the angle member 44 overlaps the handle mounting portion 56 of the base member 42.

Four rivets 82, 84, 86, and 88 are then employed to attach the blade member 36 to the base member 42; the middle two of these rivets, 84 and 86, also extend through the attachment portion 60 of the angle member 44 to securely connect the entire connecting assembly 38 to the blade member 36. A jig is preferably used to maintain the scraper blade 36, base member 42, angle member 44, and transition member 46 temporarily in the assembly configuration during the process of forming the rivets 82–88.

The debris collecting assembly 24 (FIG. 2) comprises a band 90, collection bag 92, and clips 94*a*–*e*. The band 90 is attached to the side flanges 52 and 54 of the base member 42. The exemplary band 90 is a length of flexible metal material available as steel strapping or banding material commonly used in packaging and shipping.

As perhaps best shown in FIG. 3, the band 90 is bent at four locations 90*a*, 90*b*, 90*c*, and 90*d* to define five sections

90*e*, 90*f*, 90*g*, 90*h*, and 90*i*. These sections define three sides (90*f*, 90*g*, 90*h*) and part of a fourth side (90*e*, 90*i*) of a rectangular perimeter. The The sections 90*e* and 90*i* are attached to the side flanges 52 and 54 by rivets 96 such that a collecting plane defined by the band 90 extends substantially parallel to a blade plane defined by the scraper blade 36, but is spaced slightly away (below during normal use) from the blade plane. The band 90 is preferably assembled to the base member 42 at the same time, and using the same jig, as the scraper assembly 22.

As shown in FIG. 2, the bag 92 is inserted partially through the rectangular perimeter, with its side edge 98 folded back over the outside of the band 90. The clips 94 are conventional U-clips available from Victor Cornelius as part number RD 152. These clips 94 are placed over the bag edge 98, the side wall of the bag, and the band 90 to hold the bag 92 onto the band 90. Preferably at least one clip 94 is attached to each section of the band 90, with four clips 94 (two for the band section 90*g* and one each for the band sections 90*f*, and 90*h*) being used in the preferred embodiment.

The bag 92 may be any bag that is sized and dimensioned to fit the rectangular perimeter defined by the band 90 and which is light enough to be suspended under the scraper blade 36 during use. Appropriate bags may be 4–30 gallon plastic bags widely available in supermarkets and the like. Also, plastic grocery bags are also quite suitable for use as the bag 92.

Referring now to FIGS. 2 and 3, the use of the system 20 will be described in further detail.

Initially, the acoustic texture material 26 is wetted; this weakens the internal strength of the material and its bond to the ceiling surface 28, reduces dust, and causes the texture material 26 to remain in larger, discrete clumps as it is being removed.

After the texture material is wetted, the scraper blade is brought into contact with the ceiling surface 28 with the bag 92 arranged below the scraper front edge 80 as shown in FIG. 2. By moving the scraper edge 28 in the direction shown by arrow 100 in FIG. 2, the scraper edge removes the acoustic texture material 26, with the waste material 30 being collected within the bag 92. At some point, the bag 92 will become full or too heavy. The bag 92 is then removed and discarded or emptied for reuse.

The ceiling surface 28 from which the acoustic texture material 26 is to be removed comprises an edge region, which is adjacent to the walls (such as that defining the wall surface 34) that intersect the ceiling, and a field region, which is anything that is not an edge region. In the field region, the process of using the system 20 is straightforward and is accomplished as just discussed.

The debris recovery assembly 24 extends beyond the blade edge 80 and thus will engage the wall surface 34 before the blade edge 80 when the system 20 is used in the edge region. But the band 90 is made of resilient material and is attached to the side flanges 52 and 54 such that it may deflect when it engages the wall surface 34. Accordingly, as shown in FIG. 3 the debris recovery assembly 24 does not interfere with the ability of the blade edge 80 to scrape all the way to the wall surface 34.

More specifically, the band 90 is made of a springy, resilient material that will deflect substantially without losing its desired generally rectangular shape. And by locating the rivets 96 a significant distance from the side sections 90*f* and 90*h* of the band 90, the ability of the band 90 to deflect from its normal configuration is significantly increased.

The band 90 will thus deflect as necessary to allow the scraper front edge 80 to reach the corner 32 but will spring back to its original position when the scraper front edge is sufficiently pulled away from the wall surface 34.

The system 20 may thus be used to remove acoustic texture material from substantially an entire ceiling surface, including the edge region adjacent to wall surfaces that intersect the ceiling surface.

The following Table A sets forth the dimensions of certain of the parameters described above for the preferred embodiments of the present application as well as certain ranges in which these parameters should be kept to practice the present invention.

TABLE A

| Parameter | Preferred Embodiment | First Preferred Range |
|---|---|---|
| blade length | 10" | 8–12" |
| blade width | 2" | 1.75–2.25" |
| blade thickness | 0.025" | 0.022–0.029" |
| band length | 14" | 12–16" |
| band width | 0.625" | 0.500–0.750" |
| band thickness | 0.020" | 0.015–0.025" |
| lateral distance between band side sections and band rivets | 3" | 3–4" |
| scraper angle | 20° | 15–20° |

From the foregoing, it should be clear that the present invention may be embodied in forms other than the one described above without departing from the principles of the present invention.

For example, the use of riveted, cold worked metal components to form the system 20 results in a device that is durable and relatively inexpensive to manufacture on a small scale. Cast, molded, composite, or welded components or the like may also be used with similar effect but perhaps at slightly greater cost.

If the present invention is to be manufactured on a larger scale, production costs may be reduced by manufacturing certain components out of different materials such as plastic. In this case, the scraper blade is likely to remain metal, but all of the other parts may be made out of other materials such as plastic. And the functions of certain of these parts may be combined so that one part is used where the system 20 employed two or more parts. In particular, the functions of the base member, angle member, transition member, and band may all be combined into a single injection molded plastic part.

Additionally, the exemplary band 90 is shown extending only partly around the rectangular perimeter defined thereby. This band may be made longer such that it extends entirely around this rectangular perimeter. In this case, the rivet arrangement may be slightly modified, and the band will overlap at least one of the rivet locations. A similar effect may be obtained by using two sections of band material, one as shown at 90 in the drawing and another shorter section to completely enclose the rectangular perimeter. Band material extending completely around the rectangular perimeter will increase the structural integrity of the system 90.

And if the entire perimeter is entirely enclosed by band material as just described, at least one extra clip may be used to fix the collection bag to the section of the band material adjacent to the angle member 44. A more secure attachment will thus be formed between the scraper assembly and the debris collection bag.

Accordingly, it should be recognized that various modifications can be made without departing from the basic teaching of the present invention. The scope of the invention should thus not be determined by the foregoing detailed description.

We claim:

1. An apparatus for removing and collecting debris material from a ceiling surface adjacent to a corner formed by the ceiling surface and a wall surface, the apparatus comprising:

scraping means for scraping the ceiling surface, thereby dislodging the debris material from the ceiling surface, where the scraping means comprises a base member and a scraper blade having a scraper edge; and a collecting assembly comprising a collection bag, and a collection member connected to the scraping means and adapted to support the collection bag below the scraping means such that the debris material dislodged from the ceiling surface by the scraping means falls into the collection bag, the collection member being a band of resilient material defining first, second, third, fourth, and fifth sections that is attached at first and second locations to the base member; wherein the first and fifth sections of the collection member are rigidly attached to the base member such that the second and fourth sections extend along the sides of the scraper blade and the third section extends in front of the scraper edge; and the collection member deflects when the collection member engages the wall surface to allow the scraping means to scrape the ceiling surface adjacent to the corner.

2. An apparatus as recited in claim 1, in which the scraping means comprises an extension handle that allows a user to reach the ceiling surface.

3. An apparatus as recited in claim 1, in which the scraping means comprises a connecting assembly and the scraper blade is rigidly attached to the connecting assembly, where the connecting assembly maintains the scraper blade at an angle to facilitate scraping of the ceiling surface.

4. An apparatus as recited in claim 1, in which the collection member is attached to the scraping means such that the collection member defines a closed loop.

5. An apparatus as recited in claim 4, in which the collection bag extends partially through the closed loop formed by the collection member with an edge of the collection bag extending outside of the collection member.

6. An apparatus as recited in claim 5, further comprising at least one clip for attaching the edge of the collection bag to the collection member.

7. An apparatus as recited in claim 1, in which the first and fifth sections of the collection member are attached to the base member at locations spaced from the second and fourth sections of the collection member to facilitate deflection of the collection member.

8. An apparatus for removing and collecting debris material from a ceiling surface adjacent to a corner formed by the ceiling surface and a wall surface, the apparatus comprising:

a scraper blade having a scraper edge for scraping the ceiling surface, thereby dislodging the debris material from the ceiling surface; and a collecting assembly comprising a base member to which the scraper blade is rigidly connected, a collection bag, and a collection band rigidly connected to the base member to form a closed loop, where the collection band defines first, second, third, fourth, and fifth sections and supports the collection bag below the scraper edge such that the debris material dislodged from the ceiling surface by the scraper blade falls into the collection bag; wherein the first and fifth sections of the collection member are rigidly attached to the base member such that the second and fourth sections extend along the sides of the scraper blade and the third section extends in front of the scraper edge;

the collection band is resilient and deflects when the collection band engages the wall surface to allow the scraper edge to come into contact with the corner; and the first and fifth sections of the collection member are attached to the base member at locations spaced from the second and fourth sections of the collection member to facilitate deflection of the collection member.

* * * * *